United States Patent [19]

Burke

[11] Patent Number: 4,686,427

[45] Date of Patent: Aug. 11, 1987

[54] FLUORESCENT LAMP DIMMING SWITCH

[75] Inventor: Robert V. Burke, Fort Wayne, Ind.

[73] Assignee: MagneTek, Inc., Encino, Calif.

[21] Appl. No.: 945,223

[22] Filed: Dec. 19, 1986

Related U.S. Application Data

[63] Continuation-in-part of Ser. No. 765,313, Aug. 13, 1985, abandoned.

[51] Int. Cl.[4] ..... H05B 37/02

[52] U.S. Cl. ..... 315/219; 315/220; 315/226; 315/DIG. 4; 315/DIG. 7

[58] Field of Search ..... 315/DIG. 4, DIG. 7, 315/219, 220, 226

[56] References Cited

U.S. PATENT DOCUMENTS

| | | | |
|---|---|---|---|
| 3,270,184 | 8/1966 | Negromanti | 307/257 |
| 3,323,013 | 5/1967 | Lord | 315/DIG. 4 |
| 3,463,964 | 8/1969 | Privett et al. | 315/247 |
| 3,573,544 | 4/1971 | Zonia | 315/206 |
| 3,679,935 | 7/1972 | Jacques et al. | 315/DIG. 4 |
| 3,911,320 | 10/1975 | Crawford et al. | 315/240 |
| 4,259,614 | 3/1981 | Kohler | 315/224 |
| 4,277,726 | 7/1981 | Burke | 315/98 |
| 4,284,925 | 8/1981 | Bessone et al. | 315/DIG. 4 |
| 4,353,009 | 10/1982 | Knoll | 315/DIG. 4 |
| 4,358,711 | 11/1982 | Bex | 315/208 |
| 4,371,812 | 2/1983 | Widmayer | 315/208 |
| 4,392,086 | 7/1983 | Ide et al. | 315/DIG. 4 |
| 4,469,988 | 9/1984 | Cronin | 315/209 R |
| 4,498,031 | 2/1985 | Stupp et al. | 315/224 |
| 4,527,099 | 7/1985 | Capewell | 315/226 |
| 4,560,908 | 12/1985 | Stupp et al. | 315/DIG. 7 |

OTHER PUBLICATIONS

"The Verdict is in—" by Haver, EDN, Nov. 5, 1976, pp. 65–69.

*Primary Examiner*—Harold Dixon

*Attorney, Agent, or Firm*—John M. Haurykiewicz

[57] ABSTRACT

An electronic ballast system for operating fluorescent lamps at full and partial brightness is disclosed having a series reactance selectively switched into or out of the system by a reactance switch. The electronic ballast has an input filtering section, a voltage-clamped current source, and an oscillator whose frequency is determined in part by load reactance. Series filament capacitors provide lamp filament power control during starting and running at full and partial brightness.

14 Claims, 6 Drawing Figures

| CASE | SWITCH POSITION | LAMP INTENSITY | REACTANCES | FREQUENCY | $X_I$ | $I_I$ | $X_f$ | $I_f$ |
|---|---|---|---|---|---|---|---|---|
| I | CLOSED | BRIGHT | $X_1, X_f : X_C$ $X_2 : X_C$ OR $X_L > X_1$ | LO | LO | HI | HI | LO |
| | OPEN | DIM | | HI | HI | LO | LO | HI |
| II | CLOSED | BRIGHT | $X_1, X_f : X_L$ $X_2 : X_L$ OR $X_C > X_1$ | HI | LO | HI | HI | LO |
| | OPEN | DIM | | LO | HI | LO | LO | HI |
| III | CLOSED | DIM | $X_1, X_f : X_C$ $X_2 : X_L < X_1$ | HI | HI | LO | LO | HI |
| | OPEN | BRIGHT | | LO | LO | HI | HI | LO |
| IV | CLOSED | DIM | $X_1, X_f : X_L$ $X_2 : X_C < X_1$ | LO | HI | LO | LO | HI |
| | OPEN | BRIGHT | | HI | LO | HI | HI | LO |

FLUORESCENT LAMP DIMMING SWITCH

CROSS REFERENCE TO RELATED APPLICATION

This is a continuation-in-part of the patent application for a Fluorescent Lamp Dimming Switch, Ser. No. 765,313, filed Aug. 13, 1985 now abandoned.

BACKGROUND OF THE INVENTION

The present invention relates generally to a dimming circuit for use with electronic ballasts driving fluorescent lamps.

In the past, fluorescent lamp ballasts have not readily been able to accommodate dimming. Prior art dimming approaches have often utilized continuously adjustable dimming, with the consequent increase in cost and complexity. More recently, it has been found desirable to provide for a single dimming level such that fluorescent lamps may be operated either at full brightness or at a reduced brightness, for example 50% illumination. At least one state has a requirement for such reduced level illumination availability; it has also been found desirable in applications where full brightness may be utilized under some circumstances such as during normal working hours, and where a reduced brightness may be suitable at other times, for example during after hours cleaning, or while using cathode ray terminals.

Prior art systems have not been able to provide such dimming from a single control voltage, nor have such prior art systems taken into account the varying needs in the fluorescent lamp filament circuit during dimming conditions.

SUMMARY OF THE PRESENT INVENTION

It is an object of the present invention to provide a fluorescent lamp dimming switch which is simple, low cost, and is capable of operating from a single control voltage.

Another object of the present invention is to provide a dimming switch which compensates filament voltage and current in the fluorescent lamps during dimming conditions. In the preferred embodiment of the present invention, an electronic ballast is combined with a reactance switch which selectively shunts a series reactance in series with the fluorescent lamps in the load circuit of the electronic ballast to provide dimming. In order to obtain optimum performance, it is desired to maintain filament power constant and at a minimum. However when ionization current is reduced, filament voltage and current must be increased in order to maintain lamp cathode temperature at a desired value to provide for reliable starting and at the same time maintain long lamp life. Accordingly in another aspect of the present invention, a reactance is provided in series with the fluorescent lamp filament circuits which cooperates with operation of the electronic ballast such that as lamp ionization current is reduced during dimming, filament voltage and current are increased.

DRAWINGS

DETAILED DESCRIPTION OF THE PREFERRED EMBODIMENT

Figure 1:
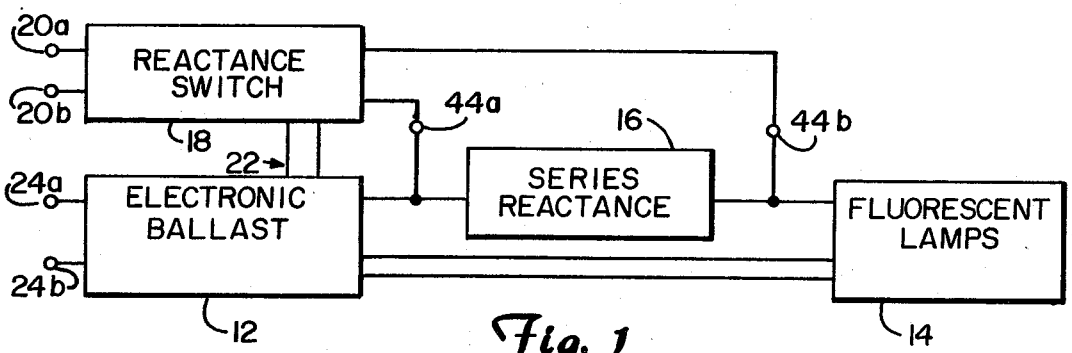
FIG. 1 is a block diagram of the main parts of the present invention.

Referring to FIG. 1, a fluorescent lamp dimming system 10 is shown, including an electronic ballast 12 driving fluorescent lamps 14 through a series reactance 16. A reactance switch 18 provides illumination control of fluorescent lamps 14 by effectively shorting out series reactance 16 in response to a signal on control input terminals 20*a,b*. Reactance switch 18 is powered from electronic ballast 12 through lines 22. Electronic ballast 12 preferably is energized through power input terminals 24*a,b*.

Figure 2:
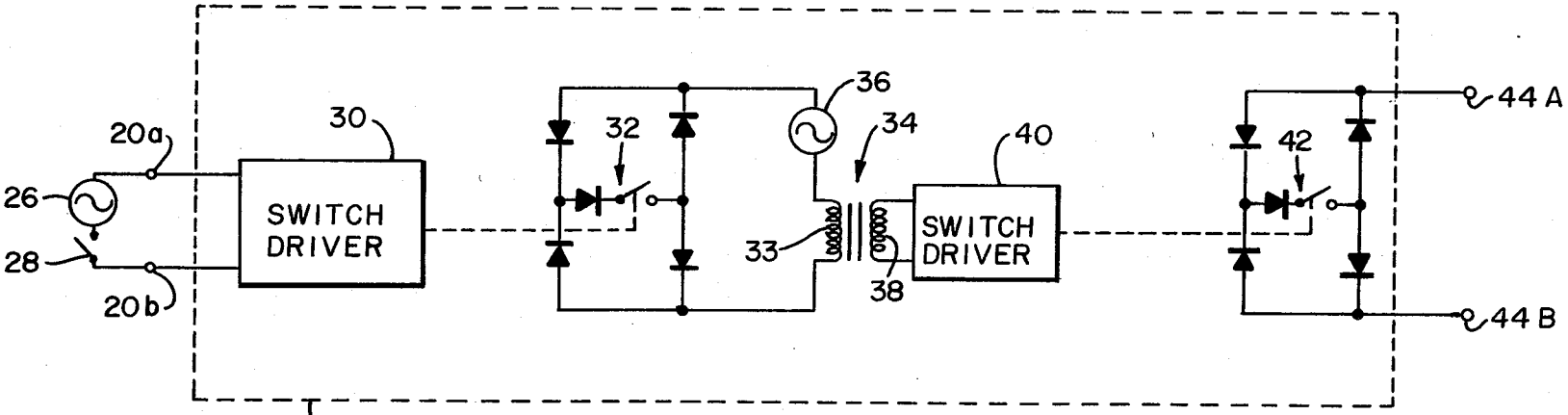
FIG. 2 is a simplified schematic of the reactance switch of FIG. 1.

Referring now more particularly to FIG. 2, a simplified schematic of the reactance switch 18 may be seen. A control input from source 26 is provided through switch 28 to input terminals 20*a,b*. In the preferred embodiment, source 26 is an AC voltage between 24 and 277 volts. When switch 28 is closed, switch driver 30 causes switch 32 to close, causing AC current to circulate in the primary 33 of transformer 34 because of AC voltage source 36. When current flows in secondary 38 of transformer 34, switch driver 40 causes switch 42 to close permitting bi-directional current at output terminals 44*a,b*.

Figure 3:
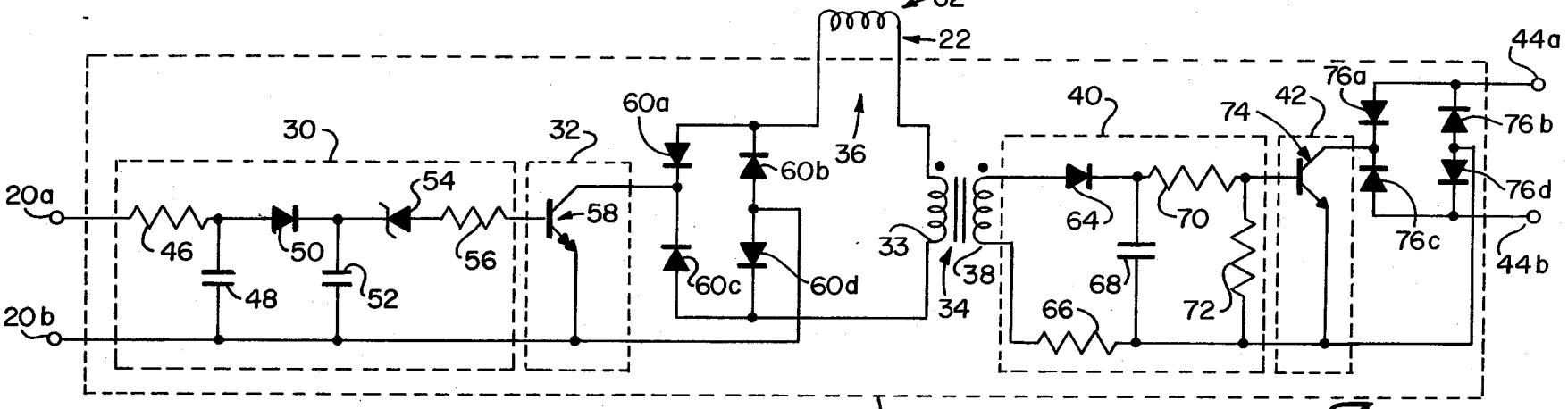
FIG. 3 is a detailed schematic of the reactance switch of FIG. 1.

Referring now more particularly to FIG. 3, a detailed schematic of the reactance switch may be seen. Part values mentioned hereinafter are values for the preferred embodiment. Switch driver 30 includes a 51K ohm input resistor 46, a 0.0039 uf capacitor 48, a conventional diode 50, a 0.1 uf capacitor 52, a 12 volt zener diode 54 and 100K ohm resistor 56. Switch 32 (which is shown as a diode in series with a switch in FIG. 2) is preferably an NPN Darlington transistor 58. A bi-directional current path for primary 33 of transformer 34 is established by diodes 60*a–d*. AC source 36 is a transformer winding 62 which receives power through lines 22 from the electronic ballast 12. Switch driver 40 includes a diode 64, a 5.1 ohm resistor 66, a 4.7 uf capacitor 68, a 75 ohm resistor 70 and a 100 ohm resistor 72. Switch 42 is a conventional NPN transistor 74. Diodes 76*a–d* provide for bi-directional current flow at terminals 44*a,b*.

Figure 4:
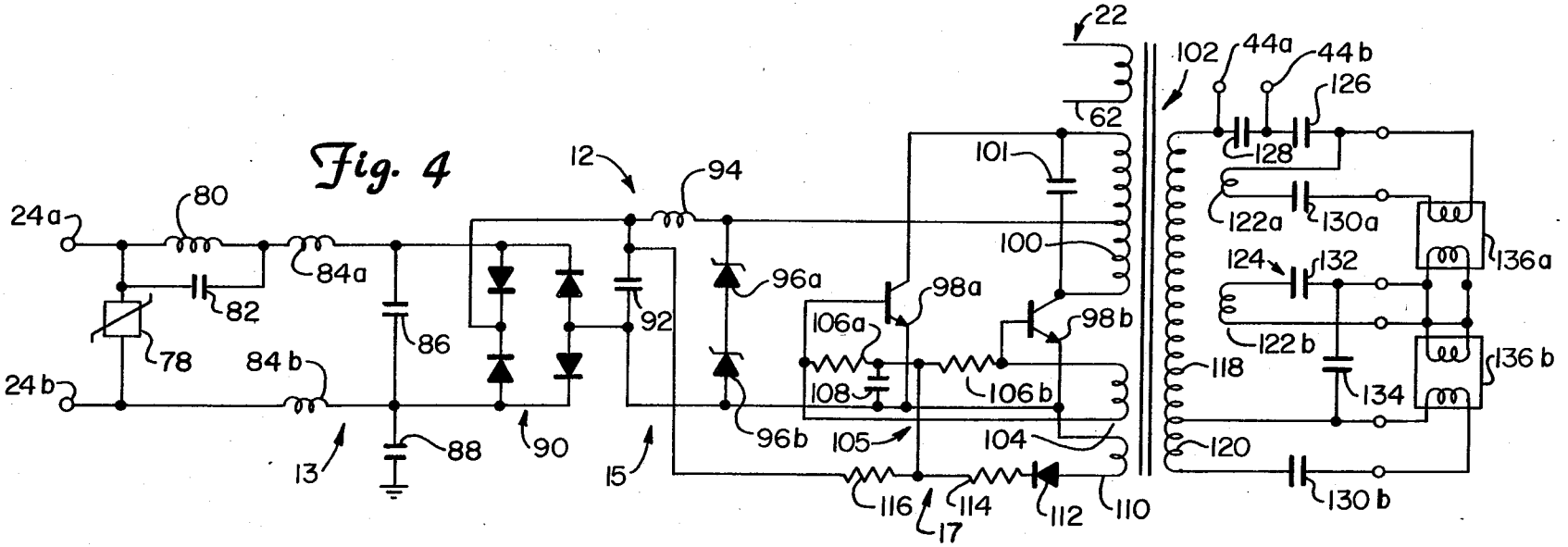
FIG. 4 is a detailed schematic of the electronic ballast, series reactance, and fluorescent lamps of FIG. 1.

Referring now particularly to FIG. 4, a detailed schematic of the electronic ballast 12 may be seen. Electronic ballast 12 is of the type having an operating frequency determined in part by the condition of the fluorescent lamp load. That is, ballast 12 operates at a relatively high frequency prior to ionization of the lamps, and at a relatively low frequency during ionization of the lamps. The input portion 13 of ballast 12 includes a pair of power input terminals 24*a,b*, a surge suppressor 78, a 150 mh inductor 80, a 3 uf capacitor 82, a pair of 50 uh inductors 84*a,b*, a 2.2 uf filter capacitor 86, a 3.9 nf noise suppression capacitor 88, and a full-wave bridge 90. This input portion 13 of ballast 12 provides input filtering, surge protection and rectification. Ballast 12 further includes a voltage-clamped current source portion 15 having a 47 uf input filter capacitor 92, a 7 mh series inductor 94, and a pair of zener diodes 96*a,b* sized to provide a 300 volt breakdown for protection of the remaining ballast circuitry.

Ballast 12 also includes an oscillator portion 17 having a pair of transistors 98*a,b* connected to either end of a center tapped primary winding 100 of a ballast transformer 102. A 4.7 nf capacitor 101 is also connected across winding 100. A feedback winding 104 provides a positive feedback signal to transistors 98*a,b* through a biasing network including two 330 ohm resistors 106*a,b* and a 10 uf capacitor 108. A bias supply winding 110 is connected through a conventional diode 112 and a 1.5 ohm resistor 114 to biasing network 105. A 120K ohm resistor 116 provides a DC bias from the input filtering circuit at capacitor 92. The additional bias obtained from winding 110 and resistor 114 permits a reduction in the power dissipation which would otherwise be required in resistor 116. Ballast transformer 102 also has a high voltage output secondary winding 118, preferably tapped to provide a low voltage filament winding 120. For multiple lamp circuit type loads, additional filament windings 122*a,b* may be provided. Ionization current is limited, in part, by a 0.0039 uf capacitor 126. The series reactance 16 (of FIG. 1) is provided by a 0.0022 uf capacitor 128. Two 0.82 uf capacitors 130*a,b* and a 1.5 uf capacitor 132 are connected in series with lamp filament circuits. A 250 pf capacitor 134 is connected between one end of output winding 118 and a floating filament current circuit 124. Fluorscent lamps 136*a,b* make up the fluorescent lamp load 14 (of FIG. 1). As noted hereinafter series reactance 16 may be (alternatively) inductive, provided other changes are made as well.

In operation, ballast 12 converts AC power received at input terminals 24*a,b* to a DC current. Capacitor 92 provides voltage filtering at the output of bridge 90. Inductor 94 provides the DC current to the remaining circuitry and isolates the input from the high frequency effects of the remaining circuitry. Diodes 96*a,b* clamp the voltage at the output of inductor 94 to a safe level for transistors 98*a,b*.

Resistor 116 provides initial startup bias for oscillator portion 17. Once transistors 98*a,b* commence oscillation, additional bias is provided from winding 110 through diode 112 and resistor 114.

The operating frequency of the ballast is determined principally by the reactance of primary winding 100 and capacitor 101 when the lamps are not ionized. Since the capacitance of capacitor 101 is relatively small, the frequency without ionization current flowing is relatively high, typically 40 KHz. When ionization current is caused to flow at full brightness, the effective capacitance is increased since the lamps 136*a,b* effectively "switch in" the capacitive reactance of capacitors 126 and 128 and the inductive reactance of winding 118. This lowers the frequency to typically 20 KHz. (If series reactance 16 is provided inductively, the starting frequency must be lower and the running frequency higher.)

Referring now to both FIG. 1 and FIG. 4, when a 0 vac signal is presented at terminals 20*a,b* reactance switch 18 is commanded "off" and the capacitive reactance of capacitor 128 is effective. When reactance switch 18 is commanded by a control signal preferably between 24 and 277 VAC, reactance switch 18 is commanded "on" and current which would normally flow through capacitor 128 is shunted around it in a manner to be described below. The high voltage at terminals 20*a,b* results in full brightness operation and zero voltage at terminals 20*a,b* results in increasing the effective reactance in series with winding 118 which results in a dimming operation for fluorescent lamps 14 with a 50% illumination level typically corresponding to an operating frequency of 30 KHz.

Series filament capacitors 130*a,b* and 132 are effective to control filament current during the various modes of operation such that high filament current is provided when there is no ionization current flowing, and a low filament current when there is normal (full brightness) ionization current flowing. An intermediate amount of filament current is provided during dimming operation. This provides filament starting and operating conditions accomplishing both reliable starting of the lamps and long filament life by "boosting" filament power for starting and "relaxing" the filament power during normal operation. Filament power is elevated slightly during dimming operation to maintain the proper cathode temperature in the lamps. If series reactance 16 is provided inductively, the series filament capacitors will be replaced by series inductive elements.

Referring now again more particularly to FIG. 3, a detailed description of the operation of reactance switch 18 is as follows. When an AC input signal above 24 volts appears across terminals 20*a,b* it is filtered and half-wave rectified by resistor 46, capacitors 48, 52 and diode 50. Voltages below this level are blocked by zener diode 54. Resistor 56 operates to limit input base current to Darlington transistor 58. With sufficient input voltage present, Darlington transistor 58 is switched "on" effectively switching "on" diodes 60*a–d* by providing a current path from the cathode of diode 60*a* to the anode of diode 60*b* and similarly providing a current path from the cathode of diode 60*c* to the anode of diode of 60*b*. Thus with transistor 58 "on", AC current from source 36 will flow through primary 33 of isolation transformer 34 which serves to isolate the control input at terminals 20*a,b* from the remainder of the system.

Current flowing in primary 33 will induce current flow in secondary 38 of isolation transformer 34, resulting in current flow through diode 64 which is rectified and filtered by resistor 66 and capacitor 68. The resulting voltage appearing on capacitor 68 is divided by a voltage divider made up of resistors 70, 72. Resistor 72 also serves to ensure that transistor 74 is biased "off" when no current is flowing in secondary 38. Transistor 74 provides a bi-directional current path in cooperation with diodes 76*a–d* in a manner similar to that of transistor 58 operating with diodes 60*a–d*. This provides a bi-directional current path available at terminals 44*a,b*, thus effectively "shorting out" capacitor 128. With no signal present at terminals 20*a,b* no current is permitted to flow in primary 33, nor output winding 38 and transistor 74 is held "off". With transistor 74 "off" diodes 76*a–d* block current flow between terminals 44*a,b* in reactance switch 18.

Referring again more particularly to FIG. 4, secondary windings 120 and 122*a,b* are preferably designed to provide 4.5 volts output. At 40 KHz, the series filament capacitors 30*a,b* and 132 are sized to preferably provide approximately 4 volts at the filaments of lamps 136*a,b*; and at 20 KHz the series filament capacitors preferably provide between 1.5 and 2.0 volts at each filament of lamps 136*a,b*.

The invention is not to be taken as incorporating all of the limitations described in the foregoing specification, as modifications may be made thereto by one skilled in the art. For instance, a single lamp load may be utilized as may be a greater number of series lamps as well by suitable reduction or increase in the cathode connections and filament windings and capacitors, along with an adjustment in the ballast output transformer secondary winding. Alternatively, as has been stated, the series reactance 16 and series filament capacitors may be replaced by inductive elements and the oscillator may be made to operate at a relatively higher frequency at full brightness and at an intermediately lower frequency during dimming operation and at a relatively lowest frequency prior to lamp ionization.

Figures 5, 6:
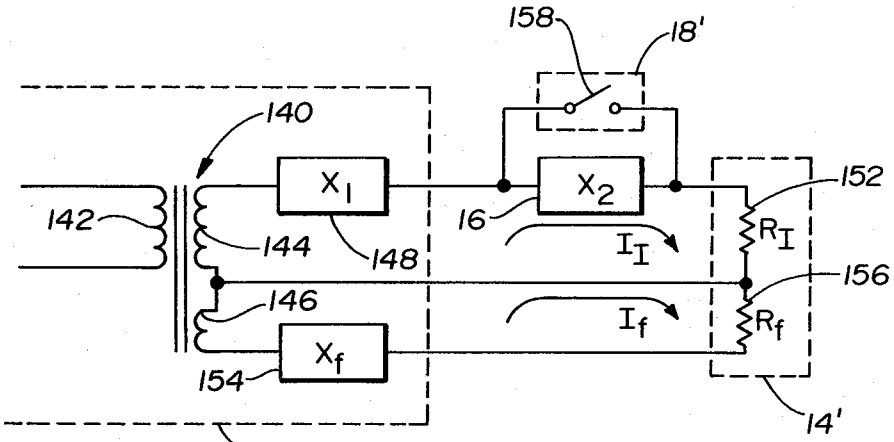
FIG. 5 is a simplified schematic showing more details of the block diagram of FIG. 1.
FIG. 6 is a table showing the relationship of operating conditions to reactance characteristics of FIG. 5.

Referring now more particularly to FIGS. 5 and 6, a simplified schematic illustrates generalized reactances and a simplified representation of the reactance switch 18. Transformer 140 is a simplified representation of ballast transformer 102 of the specific embodiment shown in FIG. 4. Transformer 140 has a primary winding 142 feeding a principal secondary winding 144 and a filament secondary winding 146. Windings 142, 144, 146 correspond generally to windings 100, 118, 120 of the specific embodiment of FIG. 4. A generalized first series reactance 148 and a generalized second series reactance 16 (corresponding to FIG. 1) are connected in series in the lamp ionization current circuit so as to permit lamp ionization current $I_I$ to flow through an equivalent series resistance 152, denoted $R_I$, in this simplified representation of a fluorescent lamp 14'. A generalized series reactance 154, denoted $X_F$, is connected in series with filament secondary 146 and a lamp filament equivalent resistance 156, denoted $R_F$, so as to permit lamp filament current $I_F$ to flow in its respective circuit comprising elements 146, 156 and 154. Switch 158 enclosed in dashed line 18' as a simplified representation of the switch 18 of FIGS. 1 and 3.

Referring now more particularly to FIG. 6, when ballast 12 is energized with switch 158 closed, lamp 14' will be initially off until ionization current $I_I$ begins to flow. At this time neither reactances $X_1$ nor $X_2$ is effectively in the circuit because there is no ionization current. Series reactance effective in the lamp ionization current circuit is given by equation (1)

$$X_1+X_2=X_I \quad (1)$$

The operating frequency of ballast 12 is principally determined by components in the circuit of primary 142 at this time. At this time lamp filament current $I_F$ flows through filament resistance 156, limited by series filament reactance 154.

Shortly after energization of ballast 12, the voltage across principal secondary winding 144 will be sufficient to ignite lamp 14', causing lamp ionization current to flow. With switch 158 closed, reactance 16 will be effectively eliminated from the ionization current circuit and reactance 148 will affect the operating frequency of the ballast. At this time, equation (1) reduces to equation (2)

$$X_1=X_I \quad (2)$$

With switch 158 open, the total series reactance of the ionization current circuit is given by equation (1). In operation, the change in lamp ionization circuit reactance illustrated by equations (1) and (2) will change the ballast operating frequency. Such changes in ballast operating frequency are utilized to regulate lamp filament current $I_F$ to desired levels through the frequency dependent filament series reactance $X_F$, 154.

Considering now more particularly Case I, both $X_1$ and $X_F$ are capacitive reactances and $X_2$ may be either a capacitive reactance or an inductive reactance greater than the reactance of $X_1$. Under these conditions, with switch 18' closed, the ballast operating frequency will be relatively low, and the effective series reactance $X_I$ will be low (because $X_2$ is shunted) resulting in a relatively high ionization current (which provides for full lamp brightness). At this time the series reactance $X_F$ in the filament circuit will be relatively high (because it is capacitive) resulting in a relatively low filament current.

Opening switch 18' will dim lamp 14' by adding in series reactance $X_2$. If $X_2$ is capacitive, the total series reactance $X_I$ will increase. If $X_2$ is inductive, it must be greater than that of $X_1$ in order to provide the desired net reactance change. Since capacitive and inductive reactances tend to cancel each other, $X_2$ must be greater than $X_1$ when $X_2$ is inductive and $X_F$ is capacitive to increase series reactance (to cause the desired dimming of lamp 14' in this case).

In Case II, $X_1$ and $X_F$ are each inductive reactances and $X_2$ is either an inductive reactance or a capacitive reactance greater than the inductive reactance of $X_1$. Opening switch 18' will result in increasing $X_I$, the effective series reactance for the ionization current circuit whether the switched reactance $X_2$ is inductive or capacitive and greater than the reactance of $X_1$. The ballast operating frequency will drop in this Case II upon switch opening with the effect of decreasing filament series reactance resulting in increasing filament current $I_F$ during dimming operation.

Cases III and IV share the characteristic that lamp intensity increases when the switch is opened in contrast to Cases I and II. In each of Cases III and IV, switch 18' is connected across the smaller of the series connected ionization current circuit reactances which are unlike each other (i.e., there is a series connected inductive reactance and a series connected capacitive reactance). In each of Cases III and IV the total of both series connected reactances limits lamp ionization current to a relatively higher level when switch 18' is open and the larger of the series connected reactances limits lamp ionization current to a relatively lower level when switch 18' is closed. In Case III, the unswitched ionization current circuit reactance $X_1$ and the filament circuit reactance $X_F$ are both capacitive and the switched ionization current circuit reactance $X_2$ is inductive and has a value less than the reactance of $X_1$, causing the frequency to shift from a relatively higher level to a relatively lower level when switching from a dim to a bright lamp intensity. In Case IV, $X_1$ and $X_F$ are inductive reactances and $X_2$ is a capacitive reactance less than $X_1$. With this arrangement, the ballast operating frequency increases when the switch is opened and causes the lamp to go from a dim to a bright intensity with the proper reduction in filament power.

In each of Cases III and IV, the ballast supplies current to filament 156 through a series reactance $X_F$ which is of the same type of the larger of the series-connected reactances $X_I$, $X_2$ in the lamp ionization current path, and lamp filament current is controlled to a relatively lower level when switch 18' is open and a relatively higher level when switch 18' is closed.

It is to be understood that this invention may be utilized with other electronic ballasts, for example that disclosed in my U.S. Pat. No. 4,277,726, the entire disclosure of which is expressly incorporated by reference herein.

Accordingly, what is claimed is:

1. In an electronic fluorescent lamp ballast of the type having an oscillator with an output transformer and first and second reactances in series with a secondary winding of the output transformer wherein the reactances are reflected back to the oscillator to affect the oscillator frequency, with the first reactance having sufficient capacitive impedance to limit the ionization current of a fluorescent lamp load and with the second reactance of sufficient impedance to affect the operating frequency of the oscillator, the improvement in combination therewith comprising:

bi-directional solid state switching means operable by an electrical signal and connected across the second reactance to change the operating frequency of the ballast by selectively shunting alternating current around the second reactance when the switching means is closed, such that:

(i) the first reactance limits lamp ionization current to a relatively higher level at a relatively lower operating frequency when the switching means is closed; and (ii) the first and second reactances limit lamp ionization current to a relatively lower level at a relatively higher operating frequency when the switching means is open.

2. The improvment of claim 1 wherein the lamp load further comprises filaments and the ballast supplies filament current to each filament through a series capacitive reactance such that lamp filament current is controlled to:

(i) a relatively lower level when the switching means is closed, and (ii) a relatively higher level when the switching means is open.

3. The improvement of claim 2 wherein the lamp filament current is controlled to a level above the relatively higher level when the lamp is not ionically conducting.

4. The improvement of claim 1 wherein the solid state switch means is operable by an alternating current control voltage.

5. The improvement of claim 4 wherein the solid state switch means further comprises a bipolar diode gate circuit controlled by a unipolar semiconductor switching device.

6. The improvement of claim 5 wherein the bipolar diode gate circuit further comprises a four terminal circuit having a pair of transmission terminals and a pair of control terminals and wherein the semiconductor switching device bridges the control terminal pair and the second capacitor bridges the transmission terminal pair such that:

(i) the four terminal circuit is operative to shunt alternating current around the second reactance when the semiconductor switching device is in its conductive state, and (ii) The four terminal circuit is operative to cause alternating current to flow through the second reactance when the semiconductor switching device is in its non-conductive state.

7. In an electronic fluorescent lamp ballast of the type having an oscillator with an output transformer and first and second reactances in series with a secondary winding of the output transformer wherein the reactances are reflected to the oscillator to affect the frequency thereof, with the first reactance having sufficient inductive impedance to limit the ionization current of a fluorescent lamp load and with the second reactance of sufficient impedance to affect the operating frequency of the ballast, the improvement in combination therewith comprising:

bi-directional solid state switching means operable by an electrical signal and connected across the second reactance to change the operating frequency of the ballast at selectively shunting alternating current around the second reactance when the switching means is closed, such that:

(i) the first reactance limits lamp ionization current to a relatively higher level at a relatively higher operating frequency when the switching means is closed; and (ii) the first and second reactances limit lamp ionization current to a relatively lower level at a relatively lower operating frequency when the switching means is open.

8. The improvement of claim 7 wherein the lamp load further comprises filaments and the ballast supplies filament current to each filament through a series inductive reactance such that lamp filament current is controlled to:

(i) a relatively lower level when the switching means is closed, and (ii) a relatively higher level when the switching means is open.

9. The improvement of claim 8 wherein the lamp filament current is controlled to a level above the relatively higher level when the lamp is not ionically conducting.

10. The improvement of claim 7 wherein the solid state switch means is operable by an alternating current control voltage.

11. The improvement of claim 10 wherein the solid state switch means further comprises a bipolar diode gate circuit controlled by a unipolar semiconductor switching device.

12. The improvement of claim 11 wherein the bipolar diode gate circuit further comprises a four terminal diode circuit having first and second terminal pairs, and wherein the unipolar semiconductor switching device further comprises a main terminal pair and a control terminal such that the device is caused to be in a conductive or non-conductive state in response to the presence or absence of an electrical signal at the control terminal, with the main terminal pair connected across the second terminal pair such that the diode circuit is:

(i) operative to conduct bipolar current from either one to the other terminal of the first terminal pair when the device is in its conductive state, and (ii) operative to prevent current flow from either one of the other terminal of the first terminal pair when the device is in its non-conductive state.

13. An improvement for use with electronic fluorescent lamp ballasts of the type having an oscillator with an output transformer and a series reactance connected between secondary winding of the output transformer and a fluorescent lamp load to limit the ionization current of the lamp load wherein the reactances are reflected and affect the oscillator frequency, the improvement in combination therewith characterized in that:

(a) the series reactance is comprised of an inductive reactance and a capacitive reactance in series;

(b) a bi-directional solid state switching means operable by an electrical signal connected across the smaller of the series-connected inductive and capacitive reactances to change the operating frequency of the ballast by selectively shunting altenating current around the smaller of the series-connected reactances when the switching means is closed, such that:

(i) the total of both series-connected reactances limits lamp ionization current to a relatively higher level when the switching means is open, and (ii) the larger of the series-connected reactances limits lamp ionization current to a relatively lower level when the switching means is closed.

14. The improvement of claim 13 further characterized in that the lamp load includes at least one filament and the ballast supplies current to the filament through a series reactance of the same type as the larger of the series-connected reactances in the lamp ionization current path such that lamp filament current is controlled to:

(i) a relatively lower level when the switching means is open, and (ii) a relatively higher level when the switching means is closed.

* * * * *